US006311455B1

(12) United States Patent
Gerard

(10) Patent No.: US 6,311,455 B1
(45) Date of Patent: Nov. 6, 2001

(54) INSULATED GLASS SPACER WITH INTEGRAL MUNTIN

(75) Inventor: Philip O. Gerard, Ada, MI (US)

(73) Assignee: ODL, Incorporated, Zeeland, MI (US)

( * ) Notice: Subject to any disclaimer, the term of this patent is extended or adjusted under 35 U.S.C. 154(b) by 0 days.

(21) Appl. No.: 09/411,555

(22) Filed: Oct. 1, 1999

(51) Int. Cl.[7] ..... E04C 2/26
(52) U.S. Cl. ..... 52/786.1; 52/786.13
(58) Field of Search ..... 52/204.6, 204.61, 52/786.1, 786.11, 786.13

(56) References Cited

U.S. PATENT DOCUMENTS

| | | | |
|---|---|---|---|
| 3,308,593 | | 3/1967 | Smith . |
| 4,198,254 | | 4/1980 | Laroche et al. . |
| 4,204,015 | | 5/1980 | Wardlaw et al. . |
| 4,358,490 | | 11/1982 | Nagai . |
| 4,652,472 | | 3/1987 | Davies . |
| 5,295,292 | | 3/1994 | Leopold . |
| 5,313,761 | * | 5/1994 | Leopold ..... 52/786.1 |
| 5,315,797 | | 5/1994 | Glover et al. . |
| 5,361,476 | | 11/1994 | Leopold . |
| 5,436,040 | | 7/1995 | Lafond . |
| 5,447,761 | | 9/1995 | Lafond . |
| 5,494,715 | | 2/1996 | Glover . |
| 5,514,428 | | 5/1996 | Kunert . |
| 5,533,314 | | 7/1996 | Kunert . |
| 5,678,377 | | 10/1997 | Leopold . |
| 5,851,627 | * | 12/1998 | Farbstein ..... 52/786.13 |
| 5,862,645 | * | 1/1999 | Lee ..... 52/786.11 |

* cited by examiner

*Primary Examiner*—Peter M. Cuomo
*Assistant Examiner*—Michael J. Fisher
(74) *Attorney, Agent, or Firm*—Warner Norcross & Judd LLP

(57) ABSTRACT

An improved insulated glass including a spacer unit and a pair of glazing panels bonded to opposite sides thereof. The spacer unit includes a peripheral spacer portion and a muntin portion within the spacer portion. The spacer unit is a one-piece, injection-molded unit, and consequently the spacer portion and the muntin portion form an inseparable integrated whole.

14 Claims, 3 Drawing Sheets

INSULATED GLASS SPACER WITH INTEGRAL MUNTIN

BACKGROUND OF THE INVENTION

The present invention relates to insulated glass and more particularly to spacers and muntins used within insulated glass.

Insulated glass is well known and widely used in a variety of applications such as doorlights. Insulated glass includes a pair of panes or panels of glass separated by a spacer. Typically, the spacer is aluminum and extends around the perimeter of the assembly, defining a space between the glass panes. The panels are adhered and sealed to the spacer to secure the assembly together. A desiccant is included within the spacer to absorb moisture within the insulated glass space. The space may be filled with an inert gas to enhance the insulation effect.

Often a muntin or grille also is included within the insulated glass. Typically, such an "internal" muntin is aluminum and is positioned between the panes within the confines of the spacer to provide an aesthetically pleasing appearance to the window. Such a construction is illustrated, for example, in U.S. Pat. No. 3,308,593, issued Mar. 14, 1967 to Smith and entitled "Panel For Inclusion In A Unit To Be Installed In A Building Opening." Unfortunately, the inclusion of the muntin is relatively expensive and labor intensive. Care must be taken during the manufacture of the muntin and the assembly of the insulated glass to ensure that the muntin is properly fabricated and positioned within the assembly. Aesthetics are important to the commercial success of the insulated glass.

SUMMARY OF THE INVENTION

The aforementioned problems are overcome in the present invention wherein a spacer unit is provided that is a one-piece, integral unit including both a spacer portion and a muntin portion. The spacer unit may be fabricated, for example, of injection-molded plastic. The spacer portion is continuous and extends around the entire perimeter of the insulated glass. The muntin portion is integral with the spacer. The glass panels are adhered to the spacer portion. The muntin portion is suspended within the space between the glass panels, and the muntin portion is spaced from the glass panels.

The present invention produces an insulated glass with an internal muntin that is simpler and less expensive than prior art insulated glass. It also provides improved aesthetic and functional benefits. The seal of the glass panels to the spacer is enhanced at the corner because the spacer portion is continuous at the corners. The spacing of the muntin portion from the glass panels reduces "rattling." Molding the spacer and muntin of plastic and spacing the muntins from the glass reduces thermal transmission through the insulated glass. Because the product includes a plastic spacer, it is less likely to generate condensation than prior art assemblies using aluminum spacers. Further, because the muntin is integral with the spacer, assembly joints are eliminated to enhance aesthetics.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
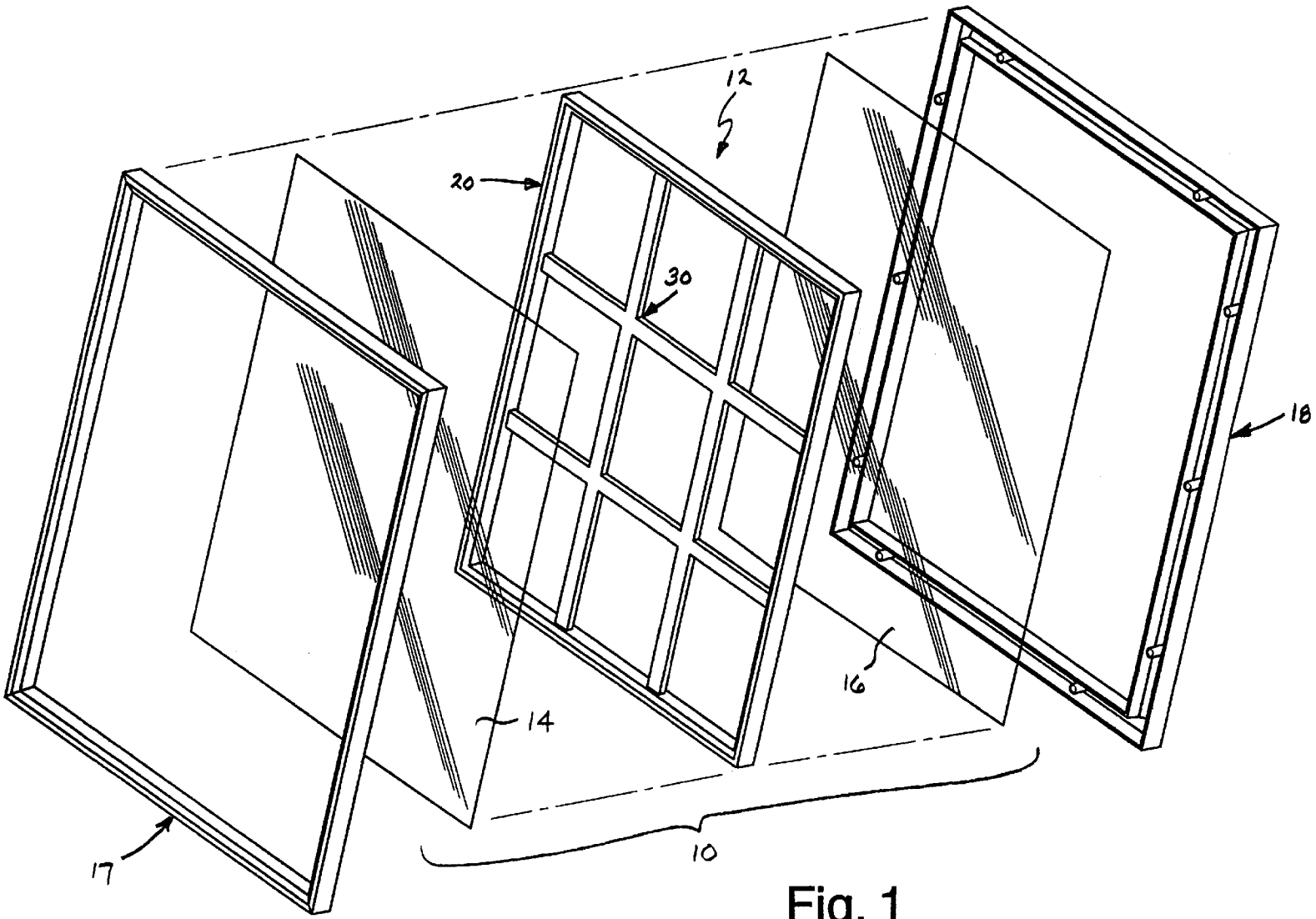
FIG. 1 is a perspective exploded view of the insulated glass of the present invention shown in conjunction with a doorlight frame.
Figure 2:
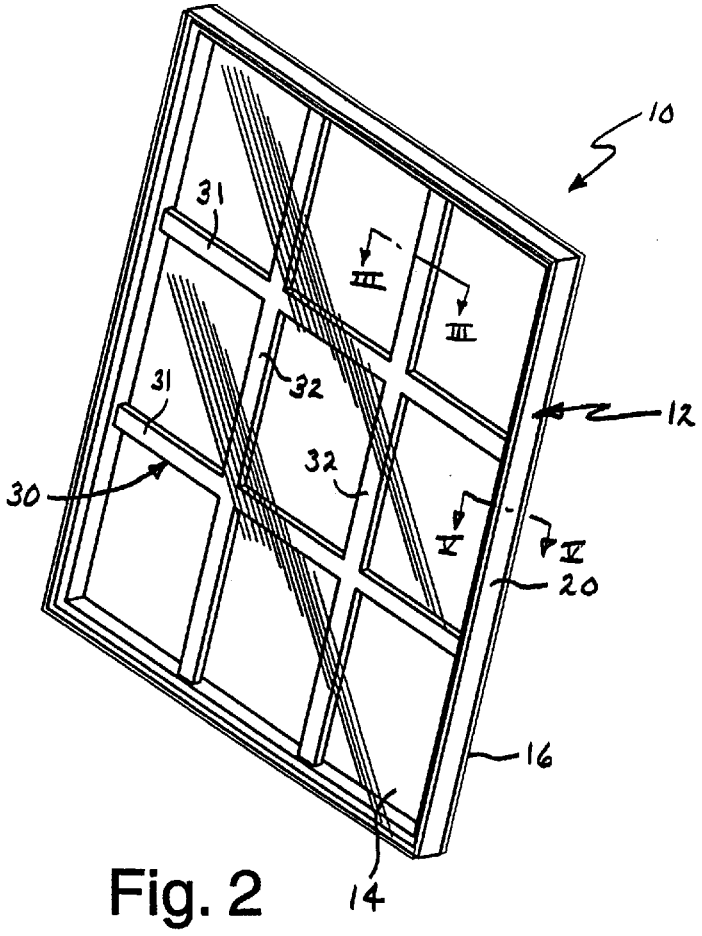
FIG. 2 is a perspective view of the insulated glass of the present invention.

An insulated glass (also referred to as IG) constructed in accordance with a preferred embodiment of the invention is illustrated in the drawings and generally designated 10. The insulated glass 10 includes a spacer unit 12 and a pair of glass panes or panels 14 and 16 adhered to opposite sides thereof. The spacer unit 12 includes a peripheral spacer portion 20 and an internal muntin portion 30. The panels 14 and 16 are adhered to the spacer portion 20 and are spaced from the muntin portion 30.

FIG. 1 illustrates the insulated glass 10 in conjunction with a pair of doorlight frame halves 17 and 18. The frame halves 17 and 18 are generally well known to those skilled in the art and therefore will not be described in detail. For example, the frame halves can be constructed in accordance with U.S. Pat. No. 5,644,881 issued Jul. 8, 1997 to Albert J. Neilly and entitled "Window Frame with Integral Connectors," the disclosure of which is incorporated by reference.

The glass panes or panels 14 and 16 also are generally well known to those skilled in the art and can be any known glazing panel. For example, the glass used in the described embodiment of the invention is a fully tempered glass that is ⅛ inch thick, such as that sold by AFG of Kingsport, Tenn. Other materials can and are substituted for the glass panels. Other suitable materials include polycarbonates, acrylics, plastics, and virtually any other translucent or transparent material.

The spacer unit 12 is new to the present invention and includes a spacer portion 20 and a muntin portion 30. The spacer portion 20 includes a body 21 having a pair of opposite channels 22 and 23 to which the panels 14 and 16 are adhered. The cross section of the spacer portion 20 is uniform throughout the entire perimeter of the spacer unit 12. The channels 22 and 23 are slightly concave to receive sealant between the spacer portion 20 and the panels 14 and 16. In the preferred embodiment, the body portion 21 maintains the panels 14 and 16 a fixed distance apart of approximately ¾ inch. The spacing may vary depending on the particular application. The spacer portion 20 includes an interior face 25 and an exterior face 24. The interior face 25 defines a pair of grooves 26 and 27, which extend the full perimeter of the spacer portion 20 to receive a desiccant or desiccant matrix 40.

Figure 3:
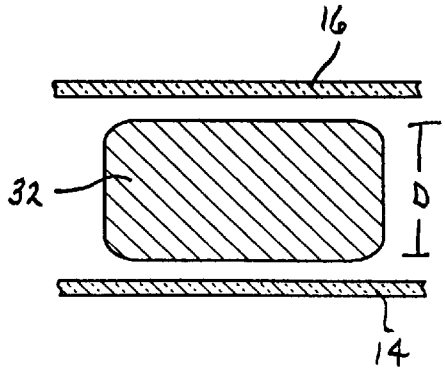
FIG. 3 is a sectional view taken along line III—III in FIG. 2.

The muntin or grille portion 30 includes one or more horizontal muntins 31 and/or one or more vertical muntins 32. The muntins 31 and 32 visually divide the insulated glass 10 into evenly sized smaller panes. However, the muntin could be constructed to visually divide the area into any desired pattern. As illustrated in FIG. 3, all of the muntins 31 and 32 are generally rectangular in cross section and are spaced from the glass panels 14 and 16 so that the panels do not and cannot engage the muntins. This construction prevents the muntins from rattling against the glass when the assembly is subjected to lateral forces, such as when a door opens or shuts. As disclosed, the depth D of the muntins is ⅜ inch.

Figure 4:
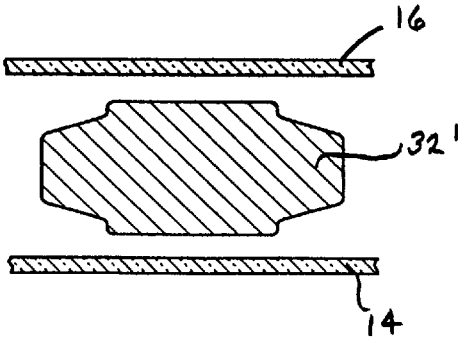
FIG. 4 is a sectional view similar to FIG. 3 showing an alternative embodiment of the muntin cross-section.

The cross section of the muntins can be varied as desired, for example, for strength and aesthetics. FIG. 4 illustrates an alternative cross section for the muntins 32'. This cross section is useful when the muntins are intended to simulate the appearance of wood moldings. The alternative muntin 32' also is spaced from both of the glass panels 14 and 16 and as a depth generally the same as that of muntin 32.

Assembly and Operation

Figure 5:
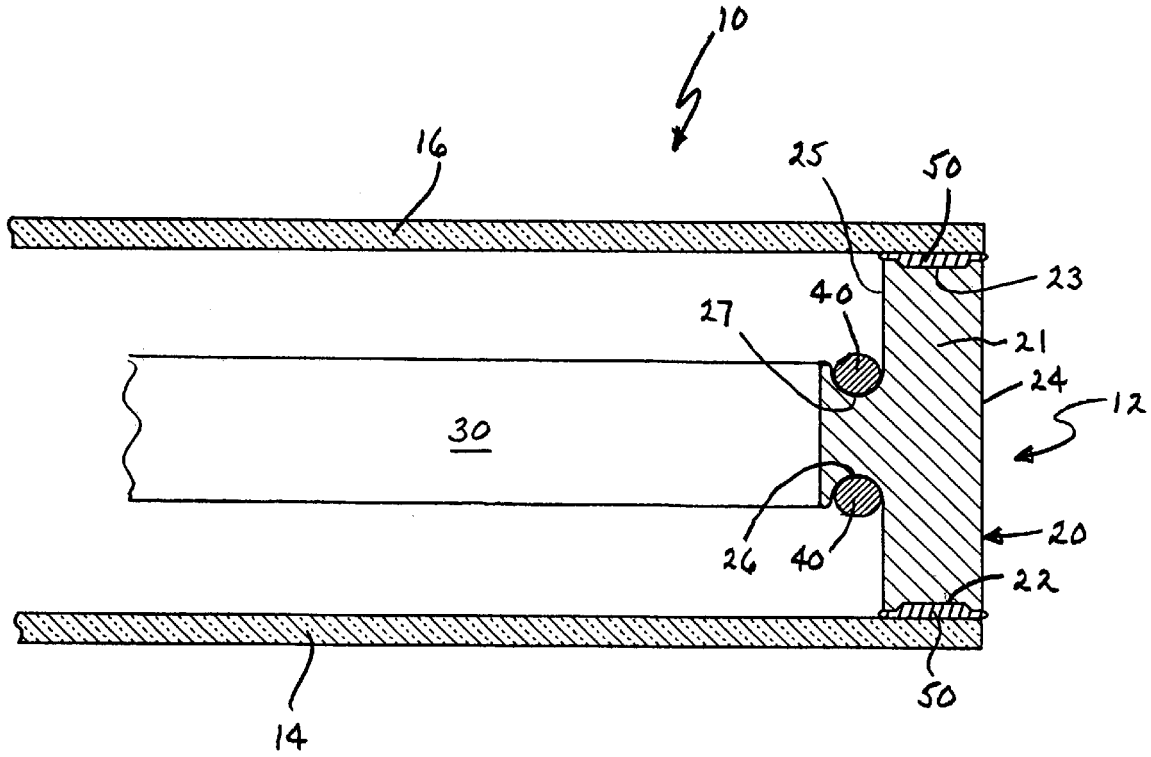
FIG. 5 is a sectional view taken along line V—V in FIG. 2.

The assembly of the insulated glass 10 is perhaps best illustrated in FIG. 5. As a preliminary step, a caulk-type desiccant matrix 40 is applied to the spacer unit 12 in either or both of the grooves 26 and 27. The currently preferred desiccant is that sold under the designation Adco Therm Desiccant Matrix by Adco of Michigan Center, Mich. Other appropriate desiccants and desiccant matrices will be known to those skilled in the art. The desiccant matrix 40 may be applied in either, both, or neither of the grooves 26 and 27; and the desiccant may extend for all or any portion of the perimeter of the spacer portion 20. It also is foreseen that the desiccant could be molded into the plastic of which the spacer 12 is fabricated.

Butyl adhesive or sealant 50 is applied to the faces 22 and 23 of the spacer portion 20. The butyl 50 extends around the entire perimeter of the spacer portion 20. The adhesive in the preferred embodiment is that sold under the designation 2000HS by Adco of Michigan Center, Mich. Other appropriate sealants are and will be known to those skilled in the art.

The panels 14 and 16 with the spacer unit 12 are laid up as a sandwich. Optionally, an edge sealant (not shown) such as polysulfide can be applied to the edge of the insulated glass 10. The entire assembly is run through pinch rollers or other appropriate equipment to improve proper adhesion of the components and to ensure consistent thickness of the glass assemblies.

Because the spacer unit 12 is fabricated of an integral, one-piece construction, the assembly has several advantages. First, the spacer portion 20 is continuous around the entire perimeter of the insulated glass 10, including in the corners. This eliminates the requirement of corner keys between individual spacer elements as are conventional in the art. Second, the muntin portion 30 is integrally and automatically provided within the insulated glass 10 as the spacer unit 12 is put into position. The positions of all muntins 31 and 32 are properly provided, and the muntins are not fragile as in prior constructions. Accordingly, the possibility of misaligning or damaging the muntin during assembly is virtually eliminated. Also, the absence of fabrication joints between crossing muntins 31 and 32 and between the muntin portion 30 and the spacer portion 20 enhances the aesthetics. Third, the spacing of the muntin portion 30 from the panels 14 and 16 ensures that the muntins do not rattle against the panes if the insulated glass is subjected to a lateral force, for example, as might occur when a window or door is slammed open or shut. Fourth, because the spacer unit 12 is plastic, thermal transmission is reduced. In summary, the insulated glass 10 with the spacer unit 12 is easier to assemble, has fewer components, is less subject to damage or failure, is more aesthetically pleasing, and provides improved thermal transmission properties than previously known insulated glass with aluminum spacers and internal muntins.

The above description is that of a preferred embodiment of the invention. Various alterations and changes can be made without departing from the spirit and broader aspects of the invention as defined in the appended claims, which are to be interpreted in accordance with the principles of patent law, including the doctrine of equivalents.

The embodiments of the invention in which an exclusive property or privilege is claimed are defined as follows:

1. An improved insulated glass of the type including a spacer and a pair of glazing panels sealed on opposite sides of said spacer, the improvement comprising said spacer comprising a one-piece integral component, said component including a continuous spacer portion defining a closed perimeter, said spacer portion sealed to both of said panels, said component further including a muntin portion within said spacer portion, said muntin portion spaced from both of said panels.

2. An improved insulated glass as defined in claim 1 wherein said one-piece integral component, including both said spacer portion and said muntin portion, comprises plastic.

3. An improved insulated glass as defined in claim 1 further comprising a desiccant adhered to said spacer portion between said panels.

4. An improved insulated glass as defined in claim 3 wherein said desiccant is in caulk form.

5. An improved insulated glass as defined in claim 4 wherein said spacer defines a groove, said desiccant being located within said groove.

6. An insulated glass comprising:

an integral one-piece spacer unit having first and second sides and including a continuous spacer portion defining a perimeter, said spacer unit further including a muntin portion defining a muntin within said perimeter; and first and second glazing panels bonded to said spacer portion on said first and second sides, respectively, of said spacer unit.

7. An insulated glass as defined in claim 6 wherein said muntin portion is spaced from said first and second panels to avoid contact therewith.

8. An insulated glass as defined in claim 6 wherein said spacer unit comprises plastic.

9. An insulated glass as defined in claim 6 further comprising a desiccant adhered to said spacer unit between said first and second panels.

10. An insulated glass as defined in claim 9 wherein:

said spacer portion defines a groove; and said desiccant comprises a caulk-type material within said groove.

11. A window assembly comprising:

a frame;

an insulated glass supported by said frame, said assembly including a spacer unit and a pair of glazing panels, said spacer unit including a peripheral spacer portion having opposite sides each secured to one of said panels, said spacer further including a muntin portion between and spaced from said panels, said spacer unit being a single, one-piece, integral component.

12. A window assembly as defined in claim 11 wherein said spacer unit comprises plastic.

13. A window assembly as defined in claim 11 further comprising a desiccant adhered to said spacer unit between said panels.

14. A window assembly as defined in claim 13 wherein:

said spacer portion defines a groove; and said desiccant comprises a caulk-type material within said groove.

* * * * *